US007744136B2

(12) United States Patent
Waltz

(10) Patent No.: US 7,744,136 B2
(45) Date of Patent: Jun. 29, 2010

(54) REMOTE REFUSE COLLECTION AND BAGGING DEVICE AND METHOD

(76) Inventor: Randall C Waltz, 3749 E. Bottsford Ave., Cudahy, WI (US) 53110

( * ) Notice: Subject to any disclaimer, the term of this patent is extended or adjusted under 35 U.S.C. 154(b) by 620 days.

(21) Appl. No.: 11/761,085

(22) Filed: Jun. 11, 2007

(65) Prior Publication Data

US 2008/0303296 A1 Dec. 11, 2008

(51) Int. Cl.
*E01H 1/12* (2006.01)

(52) U.S. Cl. ..... 294/1.4

(58) Field of Classification Search ..... 294/1.3, 294/1.4, 1.5, 19.1
See application file for complete search history.

(56) References Cited

U.S. PATENT DOCUMENTS

| | | | | |
|---|---|---|---|---|
| 3,328,066 | A | 6/1967 | Johnston | |
| 3,617,084 | A | 11/1971 | Mares | |
| 3,777,708 | A * | 12/1973 | Vogt | 294/1.5 |
| 4,248,468 | A | 2/1981 | Hastings | |
| 5,380,054 | A * | 1/1995 | Galvis | 294/1.4 |
| 5,540,470 | A | 7/1996 | Lu | |
| 6,068,311 | A * | 5/2000 | Jones | 294/1.4 |
| D461,027 | S | 7/2002 | Gardner | |
| 6,796,587 | B2 | 9/2004 | Tsou | |
| 7,093,869 | B2 | 8/2006 | Jung | |
| 7,287,790 | B1 * | 10/2007 | Kitiashvili | 294/1.4 |
| 7,618,073 | B2 * | 11/2009 | Casper | 294/1.4 |

* cited by examiner

*Primary Examiner*—Paul T Chin
(74) *Attorney, Agent, or Firm*—John K. McCormick

(57) ABSTRACT

Disclosed is a remote collection and bagging device for a sanitary and convenient means for collecting and disposing of refuse or fecal matter at a distance from a user. The device comprises a handle and trigger, a foldable extension shaft, a cable attached to the trigger and slide bars, the slide bars also connected to a set of claws which are spring biased in a normally open position and a bag retention mechanism. The claws have teeth that intermesh with each other when in a closed position such that the teeth extend past each other in order to get beneath the refuse or material being collected. Once refuse is collected, the device can be raised to a horizontal position thereby causing the collected material to fall into the attached bag for easy disposal.

10 Claims, 6 Drawing Sheets

REMOTE REFUSE COLLECTION AND BAGGING DEVICE AND METHOD

BACKGROUND OF THE INVENTION

1. Field of the Invention

The present invention relates to collection devices, and more specifically, to collapsible devices for collecting and bagging trash, garbage, debris and animal feces left on the ground without requiring the user to bend over or to manually touch the collected items.

2. Description of the Prior Art

In the area of ground and yard maintenance, whether public or private, it is often the case that garbage and debris is left on the ground or blown in by winds. For those individuals with pets or in rural areas, there is often the deposition of fecal matter by pets or wild animals roaming the grounds. As such, in order to maintain a clean and healthy environment for people, someone must periodically pick up, bag and dispose of the garbage, debris, fecal matter and other miscellaneous matter deposited on the ground. In public and business areas, this is typically accomplished by a maintenance crew, whereas in private locations it is done by the property dweller.

To do this task in a sanitary and convenient way, a collection and bagging device that allows a user's hands to be distant and/or separated from the refuse and/or feces when collecting, bagging and disposing of the refuse is desirable. It would be further desirable if the collecting, bagging and disposing device would be collapsible in order to have more efficient storage of the device when not in use or when transporting the device. To respond to such a desire, there are numerous proposed collecting devices.

U.S. Pat. No. 3,328,066, issued on Jun. 27, 1967 to Johnston, discloses a pickup device with curved jaws and an elongated handle for collecting trash but does not provide a means for bagging the collected trash or for collapsing the collecting device when not in use for convenient storage. Nor does the pickup device provide a means to get underneath the feces or trash in order to assure that the material being collected does not get smashed in the jaw teeth. U.S. Pat. No. 3,617,084, issued on Nov. 2, 1971 to Mares, discloses a hand operated shovel for collecting refuse wherein a user rotates a handle in order to open and close the trash collecting clamshell scoops but does not provide a means for bagging the collected trash or for collapsing the collecting device when not in use for convenient storage or for getting underneath the feces or trash in order to assure that the material being collected does not get smashed in the jaw teeth. U.S. Pat. No. 4,248,468 issued on Feb. 3, 1981 to Hastings, discloses a refuse collection device with an elongated handle and clamshell-like scoops that is in a normally closed position but does not provide a means for bagging the collected trash or for collapsing the collecting device when not in use for convenient storage or for getting underneath the feces or trash in order to assure that the material being collected does not get smashed in the clamshell scoops.

U.S. Pat. Nos. 5,540,470 and 6,796,587 issued on Jul. 30, 1996 to Lu and on Sep. 28, 2004 to Tsou both provide collection devices utilizing a horizontal scooping mechanism utilizing a paddle and an attached collection bag mounted to the side of the collection device. However, in the operation of these devices it is the paddle that must come in contact with the feces or trash in order to push the material into the bag thereby contaminating the paddle which necessitates the constant cleaning of the paddle after every use. U.S. Pat. No. 7,093,869, issued on Aug. 22, 2006 to Jung, discloses an animal waste collection device for use with a bag but the device does not provide a means for collapsing the collecting device when not in use for convenient storage or for getting underneath the feces or trash in order to assure that the material being collected does not get smashed in the jaws.

SUMMARY OF THE INVENTION

An object of the invention is to provide a one handed means for getting underneath refuse and fecal matter on the ground in order to contain the matter for removal and disposal without smashing the refuse or fecal matter in the jaws of the collection device.

Another object of this invention is to provide a one handed means for bagging the refuse and fecal matter using commonly available plastic shopping bags.

Yet a further object of this invention is to provide a means for collapsing the collection means when not in use for convenient storage or transportation.

To achieve the above objectives, in accordance with the present invention, there is provided a collapsible collection and bagging device comprising a handle and lockable triggering mechanism, a hollow rectangular foldable elongated shaft, normally open spring biased collection claws and a bag retention assembly removably attached to the foldable elongated shaft. The handle is attached to a first end of the elongated shaft and the triggering mechanism is pivotably attached to the handle. A cable, which runs longitudinally through the hollow elongated shaft, is attached at a first end to the triggering mechanism and at a second end to a first end of two metal bars slideably received in the second end of the elongated shaft. The second end of the first metal bar is attached to the inside surface of a first claw scoop half and the second end of the second metal bar is attached to the inside surface of a second claw scoop half. Each claw half is connected at a base end to a side of the second end of the elongated shaft by a leaf spring thereby biasing the claw halves in an open position. The claw halves are curved with teeth that are long and skinny such that when the teeth intersect, the teeth tips pass through the corresponding teeth openings on the other claw half allowing the teeth to get well below the refuse being collected. Attached to the elongated shaft, below the pivot point of the foldable elongated shaft, is a removable arm that extends down at a slight angle to the claw halves. At the end of the removable arm is a pivotal bag retention clip and an adjustable bag support ring for retaining a plastic grocery bag in an open position.

In use, a user unfolds the elongated shaft, places a plastic grocery bag, or other plastic bag, inside the circular frame member with the top edge of the bag being folded over the outside edge of the bag support ring and secures the bag in place with the bag retention clip. The user can then place the open claw ends of the claw halves over the refuse being collected and activate the triggering mechanism to close the claw halves. As the claw halves close, the claw teeth go beneath the refuse material in order to contain the material without smashing the refuse in the teeth claws. The user then lifts the device up horizontal to the ground and the refuse matter is neatly deposited into the bag. The user then grasps the top of the bag, releases the bag retention clip, ties off the bag and disposes of the refuse neatly and cleanly without directly handling the refuse and waste.

Detailed embodiments of the present invention are disclosed herein as illustrated in the drawings; however it is to be understood that the disclosed embodiments are merely exemplary of the invention, which may be embodied in various forms. In addition, although the invention is described and explained by the use of the invention's applications, there is no intent to limit the invention to the embodiment or embodiments disclosed therein. On the contrary, the intent is to include all alternatives, modifications and equivalents included within the scope and spirit of the inventions as defined by the appended claims.

BRIEF DESCRIPTION OF THE DRAWINGS

The present invention will be apparent to those skilled in the art by reading the following description of the preferred embodiments of the invention taken in conjunction with the attached drawings, which are only for illustration purposes, and are thus not meant to be limiting the present invention, and in which.

DETAILED DESCRIPTION OF THE PREFERRED EMBODIMENTS

Figure 1:
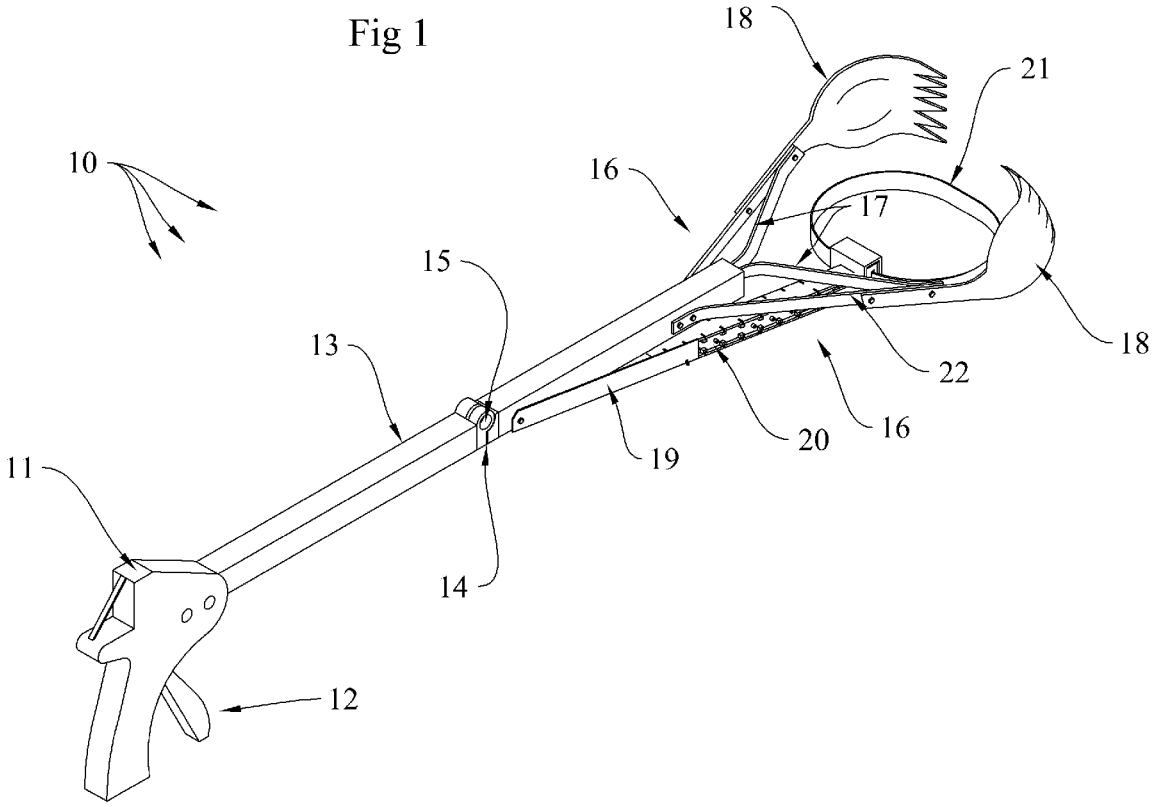
FIG. 1 is a perspective view of the present invention.

Referring now to the drawings, FIG. 1 depicts the refuse collection and bagging device 10 generally. The device 10 consists of a handle 11 with a triggering mechanism 12 fixedly mounted to a first end of a hollow pivotal shaft 13. Near the longitudinal middle of the pivotal shaft 13 is a pivot bushing 14 equipped with a locking button 15. Fixedly attached to each vertical side of the second end of the hollow shaft 13 are formed leaf springs 16 biased in an outward direction extending past the end of the hollow shaft 13. Slideably attached to the inside of the hollow shaft 13 are two flexible slide bars 17. At the outer end of each leaf spring 16 is fixedly attached a first end of one of the slide bars 17 and a multi-toothed claw half 18. The leaf springs 16 keep the claw halves 18 in a normally open position.

On the bottom side of the hollow shaft 13 is fixedly attached a bracket 19 mounted at a slight downward angle to the hollow shaft 13. Removably attached to the bracket 19 is an extension bar 20. The extension bar 20 has an adjustable circular plastic bag support ring 21 mounted at the end closest to the claw halves 18. Pivotally attached to the extension bar 20 just in front of the support ring 21 is a bag retaining clip 22.

Figure 2:
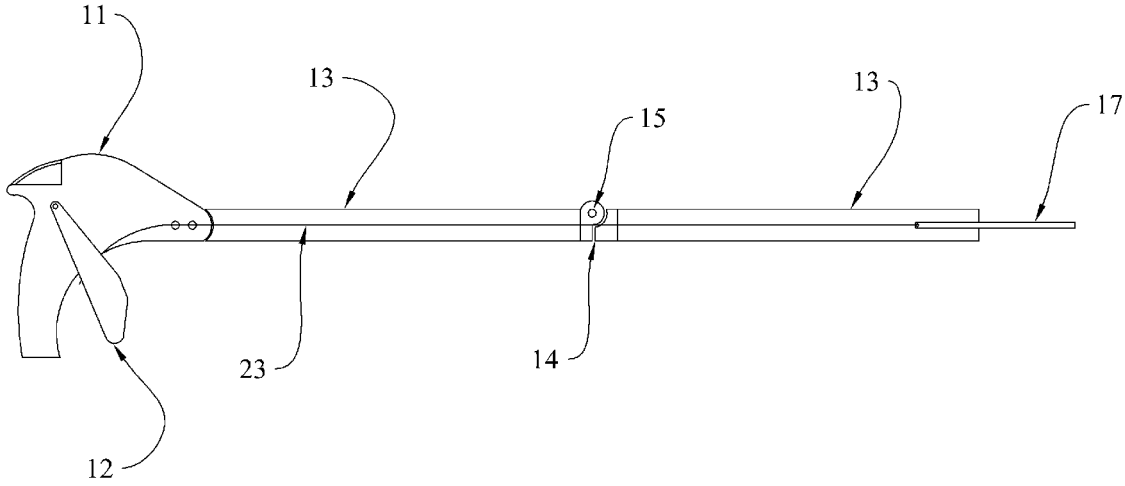
FIG. 2 is a cut away side planar view of the handle and shaft of the present invention.

FIG. 2 depicts a cut-away view of the handle 11 and hollow shaft 13. A cable 23 is attached at a first end to the trigger 12, runs inside the hollow shaft 13 towards the second end of the hollow shaft 13 and is attached to one end of the slide bars 17.

The leaf springs 16, which are attached to the claws 18 and the slide bars 17, maintain the claws 18 in a normally open position and pull outward on the slide bars 17 thereby keeping the trigger 12 in a normally open position. By squeezing or pulling the trigger 12 closed, the cable 23 attached to the trigger 12 pulls back on the slide bars 17 overcoming the force of the leaf springs 16 thereby closing the claw halves 18 together.

Figure 3:
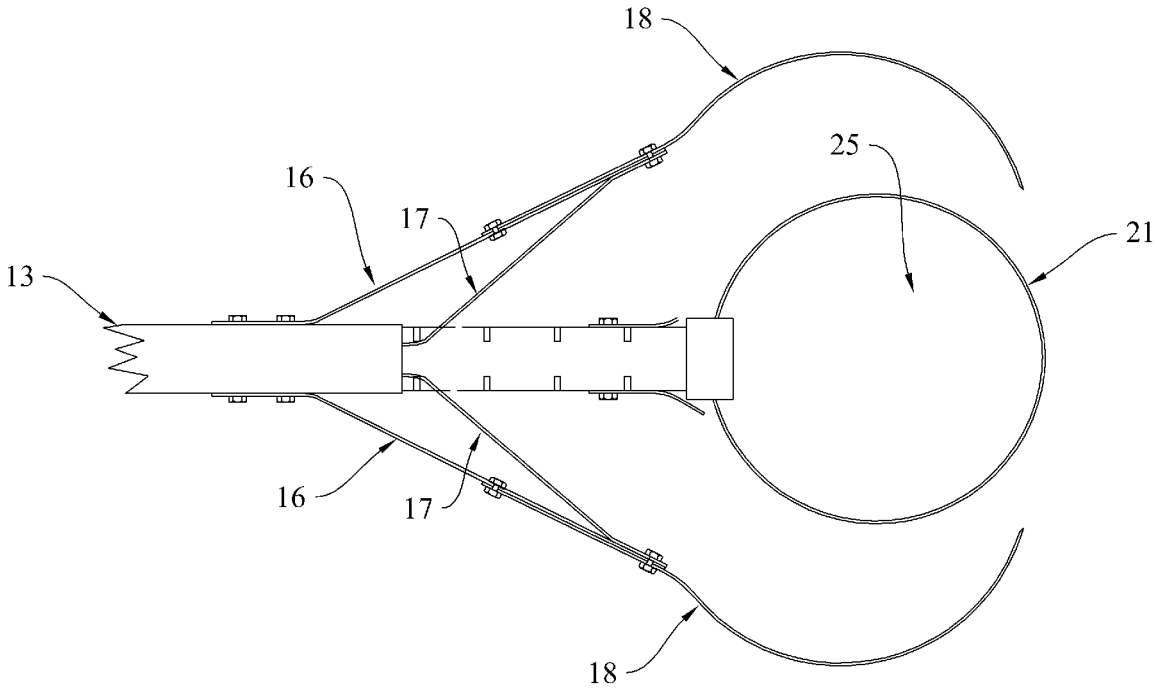
FIG. 3 is a top planar view of the claw mechanism in an open position of the present invention.
Figure 4:
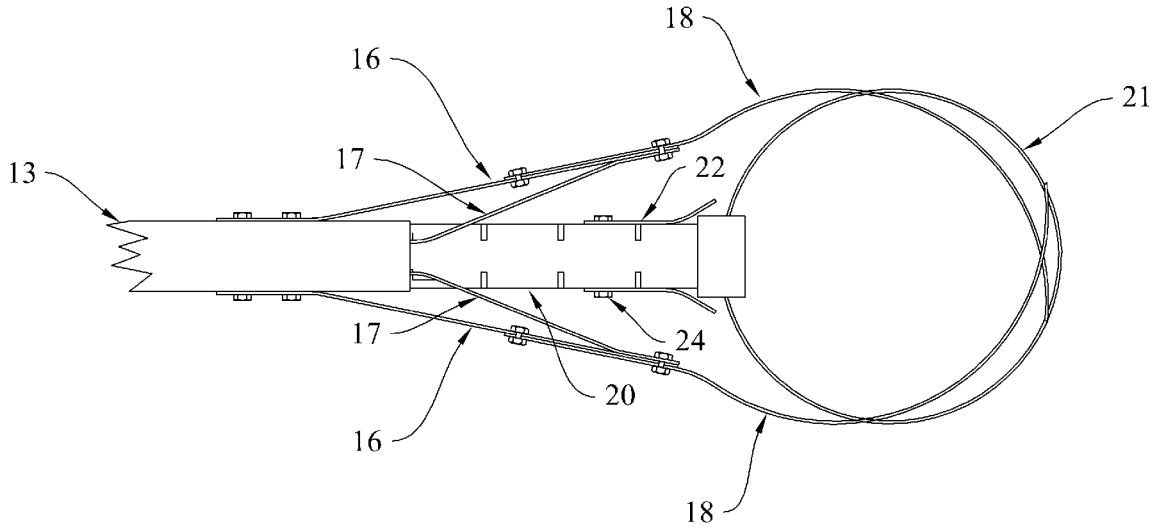
FIG. 4 is a top planar view of the claw mechanism in a closed position of the present invention.

FIG. 3 depicts the claw end of the device 10 when the claws 18 are in an opened position. The bag support ring 21 is aligned below the claw halves 18. The bag retaining clip 22 is pivotally mounted with a pivot pin 24. FIG. 4 depicts the claw end of the device 10 in a closed position. As is readily apparent in FIG. 4, in a closed position the teeth of the claw halves 18 intersect each other allowing the teeth to mesh in such a manner that the teeth protrude approximately one (1) inch past each other thereby enabling a user to get underneath refuse or fecal matter in order to contain the matter well within the containment area 25 created by the closed claw halves 18.

Figure 5:
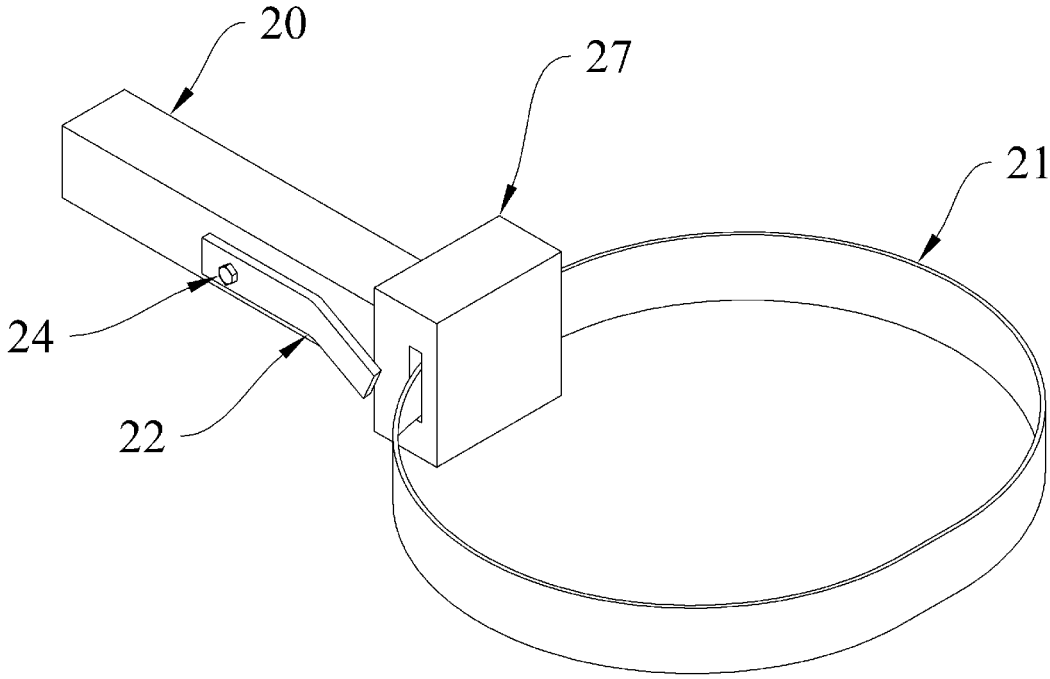
FIG. 5 is a perspective view of the bag retention mechanism of the present invention.
Figure 6:
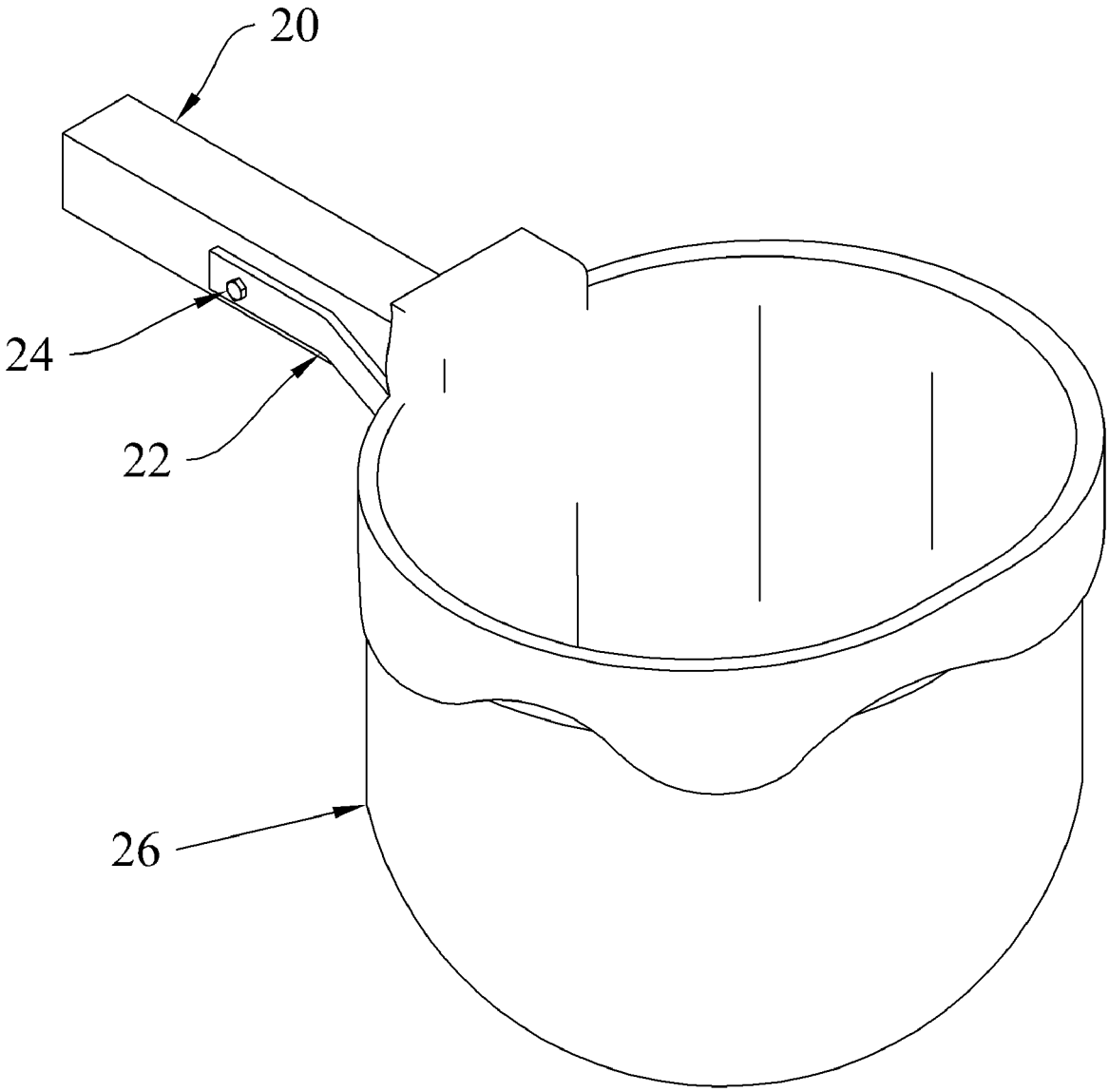
FIG. 6 is a perspective view of the bag retention mechanism with a bag attached on the present invention.

FIGS. 5 and 6 depict the bag support structure without and with a bag 26 attached to the bag support ring 21 respectively. FIG. 5 illustrates the bag support ring 21 passing through the adjustable ring holder 27. Attached to the extension bar 20 is the bag retaining clip 22. FIG. 6 depicts the bag support structure with a bag 26 attached. In use, the bag 26 is placed on the inside of the bag support ring 21 with the outer edges of the bag 26 overlapping the outside edges of the bag support ring 21. Any excess bag material is then twisted near the underside of the adjustable ring holder 27 and placed between the extension bar 20 and the bag retaining clip 22. The clip is then pushed up towards the extension bar 20 thereby holding the bag 26 in position on the bag support ring 21.

In use, a user secures a plastic bag 26 onto the bag support ring 21 as described above. The user then places the opened claw halves 18 in a vertical manner over the refuse or fecal matter desired to be collected, squeezes the trigger 12 which in turn causes the claw teeth to go beneath the matter being collected and contains the matter in the containment space 25 defined by the closed claw halves 18. The user then raises the claws 18 by tilting up the device 10 such that the device is in a horizontal position relative to the ground surface. The contained matter then falls into the bag 26 by the force of gravity. The bag 26 with the contained matter can then be removed from the device 10 by pivoting down the bag retaining clip 22, removing the bag 26, securing the open end of the bag 26 and properly disposing the bag 26 and contained matter.

When not in use, the device 10 can be folded in half by unlocking the locking button 15 and folding the device 10 about the pivot bushing 14. When folded in half, the claw halves 18 close together as the cable 23 wraps around the pivot bushing 14 pulling the slide bars 17 inward. This provides for ease of transportation and storage space reduction.

I claim:

1. A refuse and waste collection and bagging device comprising:

a handle fixedly attached to a first end of a hollow elongated shaft;

a triggering mechanism pivotally attached to said handle;

a cable attached at a first end to said triggering mechanism and at a second end to the first ends of a first and second slide bar, said cable traversing inside said hollow elongated shaft, a portion of said first ends of said first and second slide bars slideably mounted inside a second end of said elongated shaft;

first and second leaf springs, said leaf springs being fixedly attached at a first end to opposite sides of said elongated shaft;

a first and second multi-toothed curved claws, said first claw being fixedly attached to the second ends of said first slide bar and said first leaf spring and said second claw being fixedly attached to the second ends of said second slide bar and said second leaf spring, said leaf spring biasing said claws in a normally outward direction;

a bracket attached to said elongated shaft proximate the center of said elongated shaft;

an extension bar removably attached to said bracket at a first end;

an adjustable circular support ring attached to a second end of said extension bar;

a bag retaining clip pivotally mounted proximate said second end of said extension bar; and a bag wrapped over said circular supporting ring and removably secured in place by said bag retaining clip;

whereby activating said triggering mechanism causes said slide bars to slide upward into said hollow shaft overcoming said leaf springs bias causing said curved claws to pivot inward until said claw teeth intermesh thereby creating an open-ended containment area for said refuse and waste.

2. A refuse and waste collection and bagging device according to claim 1, further comprising a pivot bushing and locking button located proximate the longitudinal center of said elongated shaft to allow a user to fold said device in half for compact storage or transportation, said locking button keeping said elongated shaft in a longitudinal position when said pivotal bushing is opened.

3. A refuse and waste collection and bagging device according to claim 1, wherein said first and second multi-toothed claws have teeth that are elongated and offset such that said teeth of said first claw intermesh with the teeth openings of said second claw and said teeth of said second claw intermesh with the teeth openings of said first claw such that the tips of the said teeth protrude beyond the intersection point of said first and second claws, thereby allowing said claw teeth to get beneath said refuse and waste and lifting said refuse and waste into said open-ended containment area.

4. A refuse and waste collection and bagging device according to claim 1, wherein said cable is a linkage bar.

5. A refuse and waste collection and bagging device according to claim 1, wherein said cable is a fiber rope.

6. The collection and bagging device of claim 1 wherein said curved claws are formed of materials selected from the group of materials consisting of aluminum, steel, plastic and carbon epoxy.

7. A means for collecting and bagging refuse and waste comprising:

selecting a device with two claw halves and a bag support ring attached to a first end of an elongated shaft and a handle and triggering mechanism at a second end of said elongated shaft, said bag support ring having a bag attached thereto;

a means for biasing said two claw halves in a normally open position;

a means for placing said claw halves over refuse to be collected;

a means for activating said triggering mechanism, said activation causing said normally open claw halves to close thereby collecting said refuse and waste in between said claw halves; and re-positioning said device to a horizontal position thereby causing said refuse and waste to fall into said bag.

8. The means according to claim 7 further comprising a means to fold said device in half and a means to unfold and lock said device in an open position.

9. The means according to claim 7 further comprising said two claws halves with teeth that are elongated and offset such that said teeth of said first claw intermesh with the teeth openings of said second claw and said teeth of said second claw intermesh with the teeth openings of said first claw such that the tips of the said teeth protrude beyond the intersection point of said first and second claws.

10. The means according to claim 7 wherein said curved claws are formed of materials selected from the group of materials consisting of aluminum, steel, plastic and carbon epoxy.

* * * * *